US005636559A

United States Patent [19]

Smithwick, Jr. et al.

[11] Patent Number: 5,636,559

[45] Date of Patent: Jun. 10, 1997

[54] ELASTOMERIC SCRAP EJECTOR FOR A CUTTING DIE

[76] Inventors: James M. Smithwick, Jr., 1 Shepard Springs Ct., Durham, N.C. 27713; Jack R. Simpson, Rte. 3, Box 467-N, Raleigh, N.C. 27603; Jeffrey Geer, 3424 Ashmill Ct., Apex, N.C. 27502

[21] Appl. No.: 400,547

[22] Filed: Mar. 8, 1995

Related U.S. Application Data

[63] Continuation of Ser. No. 117,533, Oct. 7, 1993, abandoned.

[51] Int. Cl.[6] ..... B26D 7/18

[52] U.S. Cl. ..... 83/116; 83/128; 83/139; 493/82; 493/342; 493/472

[58] Field of Search ..... 83/116–118, 123–126, 83/128, 138–140, 658, 659, 669, 670, 142, 143, 145; 493/82, 83, 342, 373, 472

[56] References Cited

U.S. PATENT DOCUMENTS

| | | | |
|---|---|---|---|
| 3,046,824 | 7/1962 | Mohr | 83/658 |
| 3,167,985 | 2/1965 | Madsen | 83/139 |
| 3,282,142 | 11/1966 | Sauer | 83/659 |
| 3,827,322 | 8/1974 | Saunders et al. | 83/128 |
| 4,075,918 | 2/1978 | Sauer | 83/659 |
| 4,499,802 | 2/1985 | Simpson | 83/117 |
| 4,522,095 | 6/1985 | Saunders et al. | 83/123 X |

*Primary Examiner*—Rinaldi I. Rada
*Assistant Examiner*—Clark F. Dexter
*Attorney, Agent, or Firm*—Rhodes, Coats, & Bennett, LLP

[57] ABSTRACT

A resilient-scrap ejector is provided for a cutting die. The scrap ejector includes an elongated body made of a resilient material. The elongated body includes a longitudinally-extending web. A plurality of lugs extend from opposite sides of the web and are separated by notches. The notches provide void spaces which allow for deformation for the elongated body when the elongated body is subjected to compressive forces. The scrap ejector is located in a cavity or recess formed in the cutting die for ejecting and stripping scrap severed from the blank. By providing displacement zones or voids, the height of the scrap ejector can be increased without compressing the material beyond the limits of its resiliency.

14 Claims, 7 Drawing Sheets

ELASTOMERIC SCRAP EJECTOR FOR A CUTTING DIE

This application is a continuation of application Ser. No. 08/117,533, filed Oct. 7, 1993, now abandoned.

The present invention relates to a cutting die for producing a container or carton blank from a sheet material, such as corrugated paper board. More particularly, the present invention relates to an elastomeric scrap ejector for a cutting die for stripping scrap free from the blank.

BACKGROUND OF THE INVENTION

Cutting dies are commonly used for manufacturing boxes, cartons, and container blanks from a sheet material such as corrugated paper board. The cutting die includes a series of cutting rules arranged in the shape of the blank to be formed. Often times, the blank will include one or more narrow slots. For example, carton blanks frequently include three narrow slots separating the flaps on the carton. Larger slots are also used to form hand holds for a carton.

When slots are formed in a blank, a narrow piece of scrap is severed from the carton. It is desirable to strip the severed scrap from the blank as the blank passes through the rotary die. In the past, resilient rubber strips made of closed cell, high density foam or gum rubber have been placed in the cavities between cutting rules to eject the blank and strip the scrap. These rubber ejectors/strippers (hereinafter "ejector") rely on the resiliency of the material to strip the scrap. The ejector is compressed during the cutting operation and subsequently expands when the cutting die is moved away from the blank. As the rubber ejector expands, the scrap is held against the anvil cylinder and stripped from the blank. Simultaneously, the corrugated is ejected off the die with the similar rubber ejectors.

The rubber scrap ejectors used in the past have been less than fully effective in stripping scrap from the blank. One way to improve performance of the scrap ejector is to increase the height of the ejector. As a general rule, the greater the height of the ejector, the more it will be compressed during cutting and the more effective it will be in stripping the scrap. However, there is a practical limit on how much the scrap ejector can be compressed, and thus, a limit on the height which can be obtained. If the scrap ejector is compressed beyond the limits of its resiliency, then the scrap ejector may be permanently deformed and its effectiveness in stripping scrap is seriously impaired.

SUMMARY AND OBJECTS OF THE INVENTION

The present invention provides a resilient scrap ejector for a cutting die. The scrap ejector includes an elongated body having a top portion and a bottom portion. The top portion includes a plurality of first longitudinally-spaced lugs and notches which extend along the entire length of the scrap ejector. The bottom portion includes a plurality of second, longitudinally-spaced lugs and notches which are complimentary to the lugs and notches on the top portion. The notches in the top and bottom portions provide a displacement zone for the body member when the body member is subjected to compression. Thus, when the body member is easily deformed when subjected to compression.

By providing room for the displacement and deformation of the body member, it is possible to increase the height of the scrap ejector without overloading the ejector when it is compressed. The increased height of the ejector results in a significant improvement in the performance of the ejector.

Thus, the geometry of the scrap ejector combines with the resiliency of the material to enhance the performance of the ejector.

Another advantage of the present invention is that a greater number of ejectors can be produced from a given amount of sheet material. This increased yield is the result of two factors. First, the total surface area of the scrap ejector, when viewed in elevation, is less than a prior art scrap ejector of similar height due to the presence of the notches. Secondly, the top and bottom portions of the scrap ejector are complimentary. The complimentary edge configuration allows the lugs of one ejector to be nested in the notches of another ejector and results in a greater yield from a given amount of sheet material.

Another advantage of the present invention is that it increases substantially the useful life of the ejector. In prior art ejectors, the cells of the ejector are repeatedly compressed which eventually wears out the rubber. In the present invention, the cells are compressed to a lesser extent so that rubber does not wear down as fast. By increasing the useful life of the ejector, downtime is reduced and productivity is increased in a rotary die operator.

Finally, the present invention eliminate stress along the outer surface of the scrap ejector. In prior art scrap ejectors, the outside surface of the scrap ejector experiences tension and the inside surface experiences compression when the ejector is bent. By providing notches along the top and bottom portions, the present invention eliminates these stresses.

DETAILED DESCRIPTION OF THE INVENTION

Figure 1:
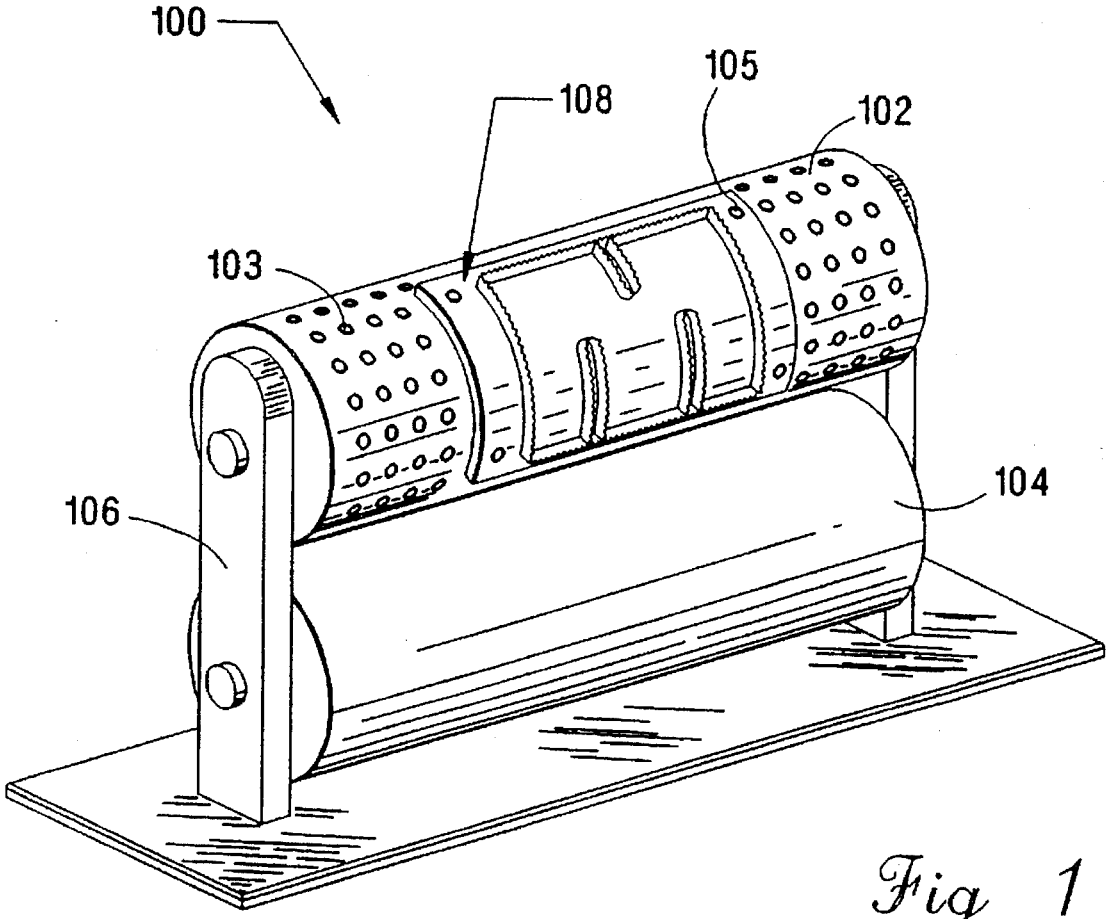
FIG. 1 is a schematic view in perspective of a rotary die machine.

Referring now to the drawings, and particularly to FIG. 1, a rotary die cutter is shown therein, and indicated generally by the numeral 100. The rotary die cutter 100 includes an upper die roll 102 and a lower anvil roll 104 which are rotatably mounted in a frame 106 in parallel-spaced relation to one another. The die roll 102 and anvil roll are typically driven by suitable drive means (not shown) in opposite directions and a sheet material is fed between the rolls 102 and 104.

The anvil roll 104 typically consists of a metal cylinder having a resilient layer made of urethane or other suitable material. The die roll 102 also includes a metal cylinder which has a plurality of threaded bores 103 arranged in parallel rows. A cutting die, indicated generally at 108, is fixed to the core of the die roll 102 by threaded fasteners 105 that screw into the threaded bores 103 of the die roll 102.

Figure 2:
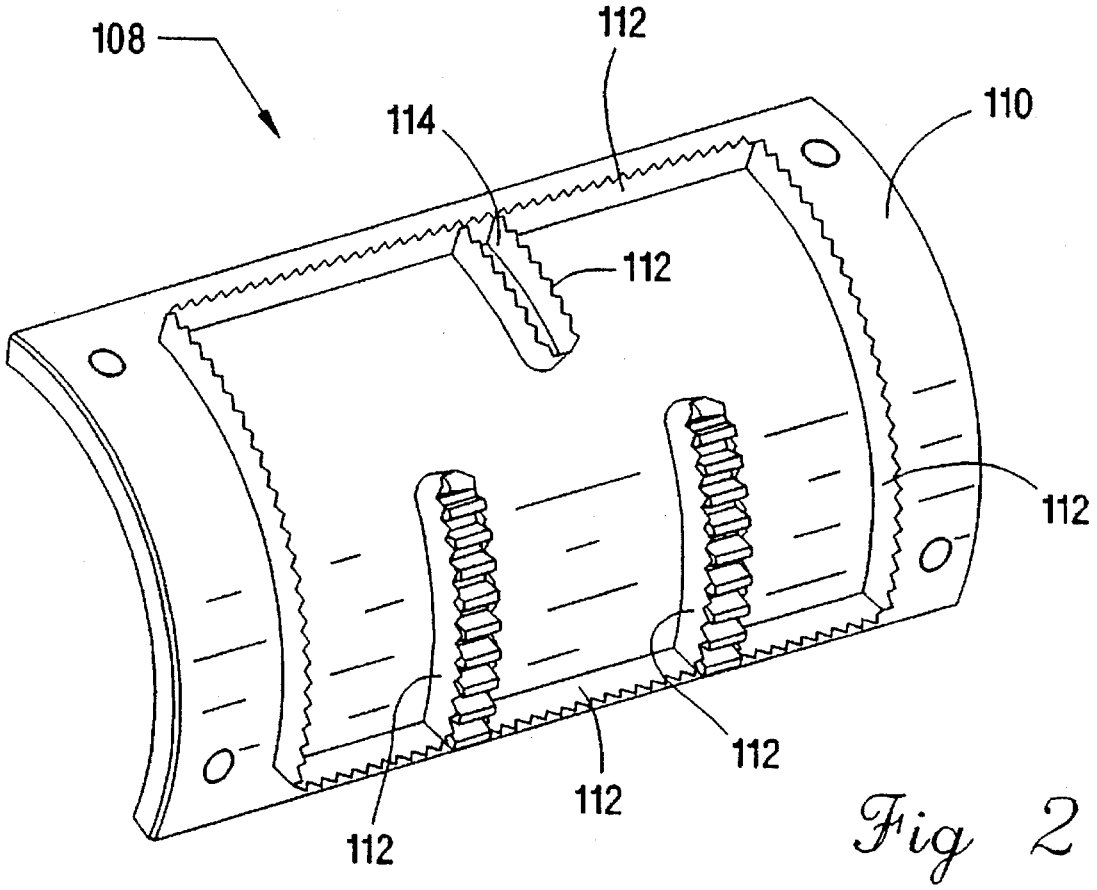
FIG. 2 is a perspective view of a cutting die.

Referring now to FIG. 2, there is shown a perspective view of a cutting die 108. The cutting die 108 includes a die board 110 from which steel cutting rules 112 project. Other types of rules, such as creasing rules or perforating rules are also commonly used but are not shown in the figures. The die board 110 is usually made from a high quality plywood, such as maple, formed into an arcuate shape. The cutting rules 112 are inserted into saw cuts made in the die board 110.

When producing a blank for a box, carton, or container, it is common to produce slots for flaps or tabs. To form the slot, a cutting rule 112 is bent into a U-shaped configuration as shown in FIG. 2. A cavity or recess 114 is thus formed between the sides of the U-shaped cutting rule 112. The scrap severed from the corrugated paper board is received in the cavity or recess 114 when the cutting die 108 is moved into contact with the corrugated paper board. It is necessary to eject this scrap as the cutting die 108 moves out of contact with the corrugated paper board to prevent the scrap from clogging the cutting die 108 and rendering it inoperative.

Figure 3:
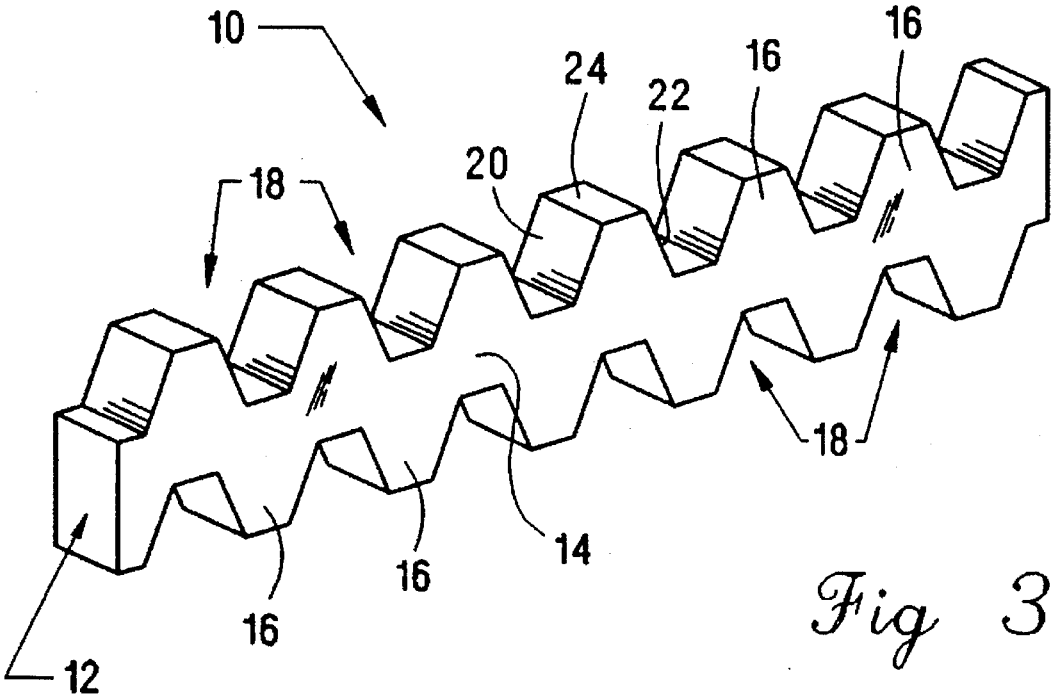
FIG. 3 is a perspective view of the scrap ejector of the present invention.
Figure 4:
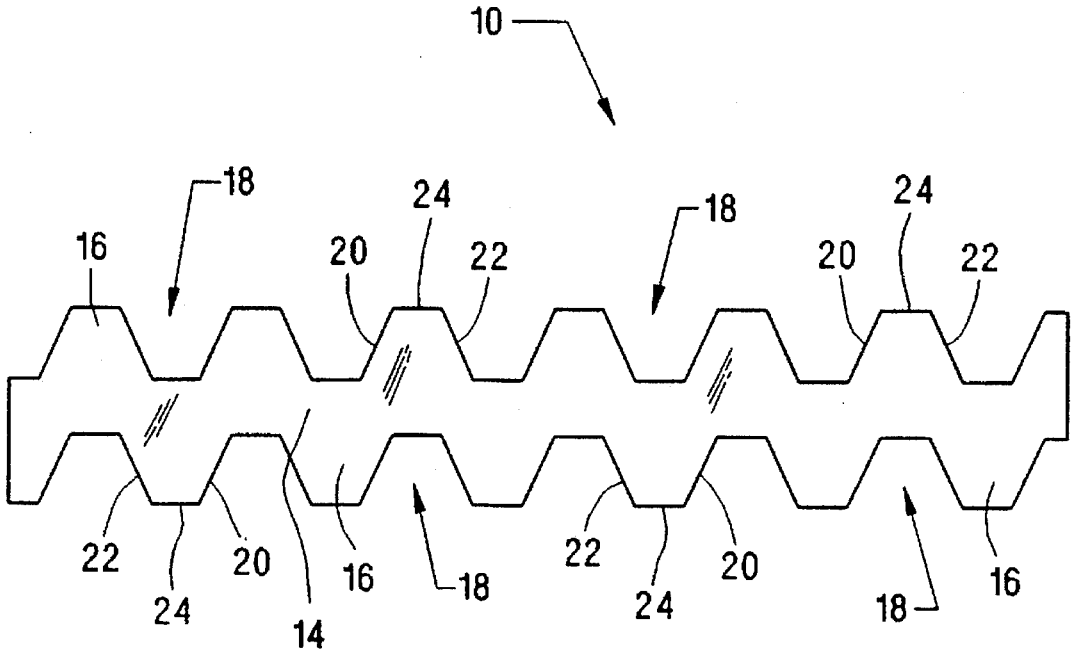
FIG. 4 is a longitudinal-elevation view of the scrap ejector.

To eject and strip scrap from the recess or cavity 114 in the cutting die 108, a resilient, scrap ejector 10 of the present invention is placed within the recess or cavity 114. The scrap ejector 10 is preferably made of a closed cell, high-density foam rubber having a durometer of 70–90 on the Shore 00 scale. As shown in FIGS. 3 and 4, the scrap ejector 10 comprises an elongated body 12 having a longitudinally-extending web 14. A plurality of or compressive elements 16 project from the top and bottom surfaces of the web 14. The lugs 16 are separated by relief areas or notches 18.

Each of the lugs 16 includes a pair of side walls 20 and 22 which extend outwardly from the web 14 to an outer contact face 24. In the preferred embodiment, the lugs 16 are of uniform height and the outer contact faces 24 of the lug 16 define first and second contact surfaces.

Figure 5:
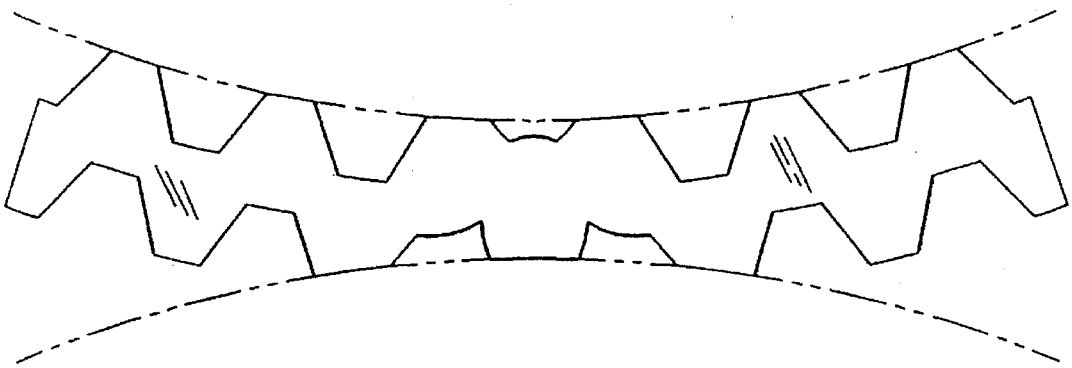
FIG. 5 is a longitudinal-elevation view of the scrap ejector showing a compressive force applied to a portion thereof.

In the embodiment shown in FIG. 3, the lugs 16 are staggered on opposite sides of the web 14. Thus, each lug 16 is disposed opposite a corresponding notch 18 on the opposite side of the web 14. When a compressive force is applied to the lug 16, as shown in FIG. 5, the lug 16 is subject to both compression and displacement into the opposing notch 18. Thus, the notches 18 provide a displacement zone for the elongated body 12 when the scrap ejector 10 is subjected to compressive forces.

Figure 6:
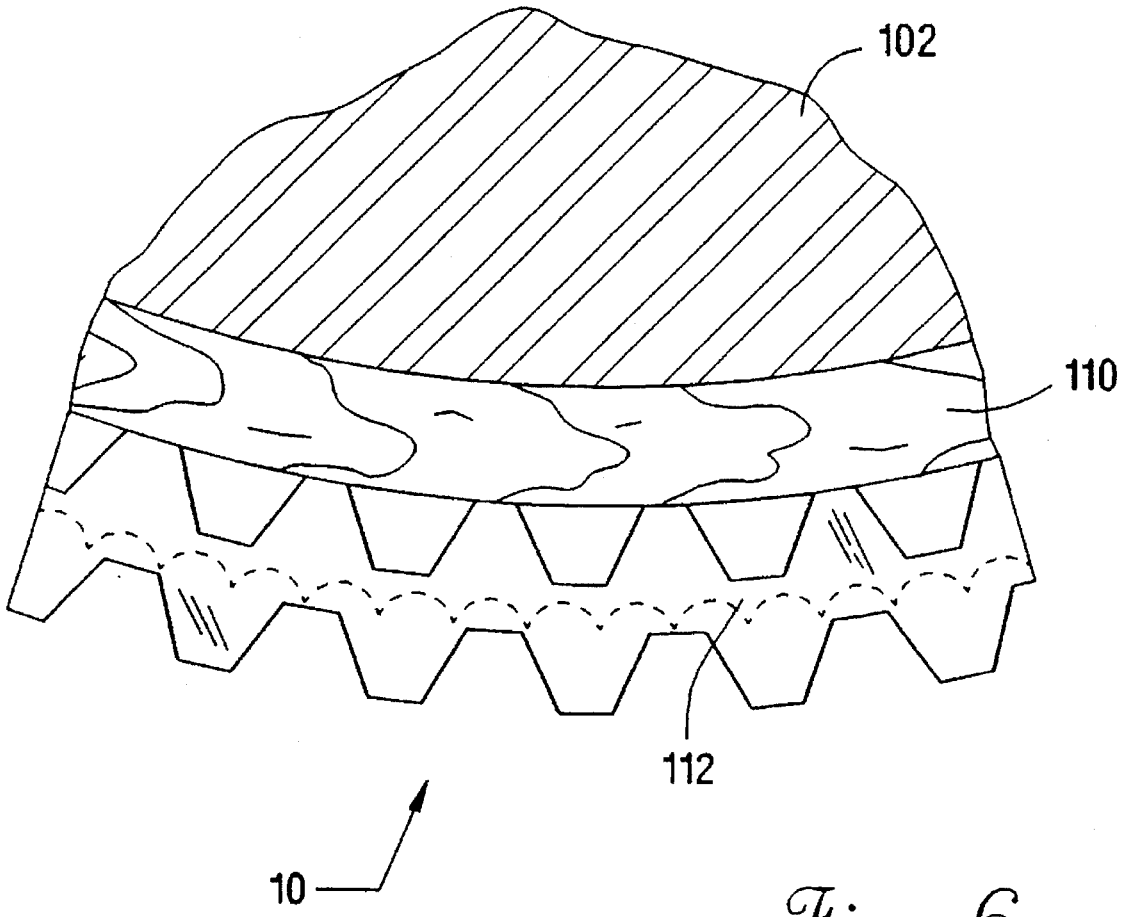
FIG. 6 is a fragmentary-section view of a die cylinder showing a die board, cutting rule, and scrap ejector.

In use, the scrap ejector 10 of the present invention is secured within a recess or cavity 114 on the cutting die 108 as shown in FIG. 6. The outer faces 24 of the lug 16 on one side of the web 14 are secured by a suitable adhesive to the die board 108. The lugs 16 on the opposite side of the web 14 extend above the edge of the cutting rule 112. The height of the scrap ejector 10 is such that the outer faces 24 extend beyond the cutting edges of the rule 112 to ensure proper ejection of the scrap. When the scrap ejector 10 is compressed as the die moves into contact with a corrugated paper board, the scrap ejector 10 is easily deformed. The lugs 16 become compressed and are displaced into the notches 18. By allowing room for displacement of the lug 16, the present invention avoids the problem of overloading and permanently deforming of the scrap ejector 10. As the scrap ejector 10 passes through the rotary die, it holds the scrap against the anvil cylinder 104 so that the scrap is stripped from the blank.

In prior art ejectors, the ejector could be comprised to approximately 50% of its original height without damaging the rubber. Since the present invention provides a displacement zone for the rubber, the scrap ejector 10 can be compressed to approximately 30% of its original height without damage so that a taller ejector can be used. Further, since the rubber is displaced, the individual cells of the rubber are compressed to a lesser extent than in prior art ejectors. As a result, the useful life of the ejector is significantly increased.

Figure 7:
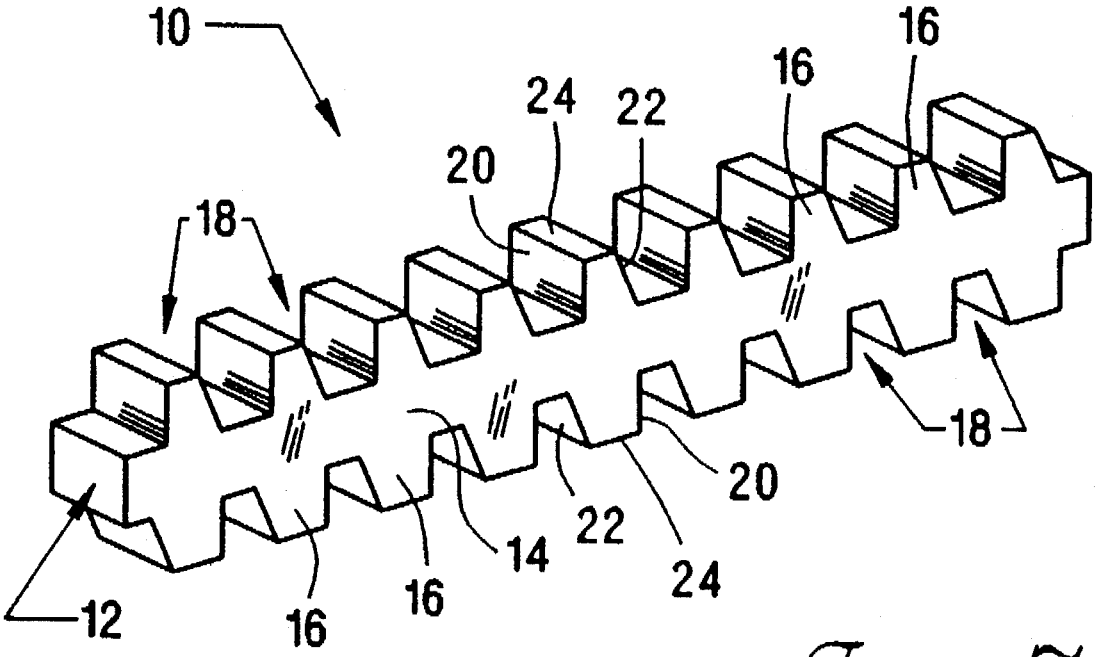
FIG. 7 is a perspective view showing a second embodiment of the scrap ejector.
Figure 8:
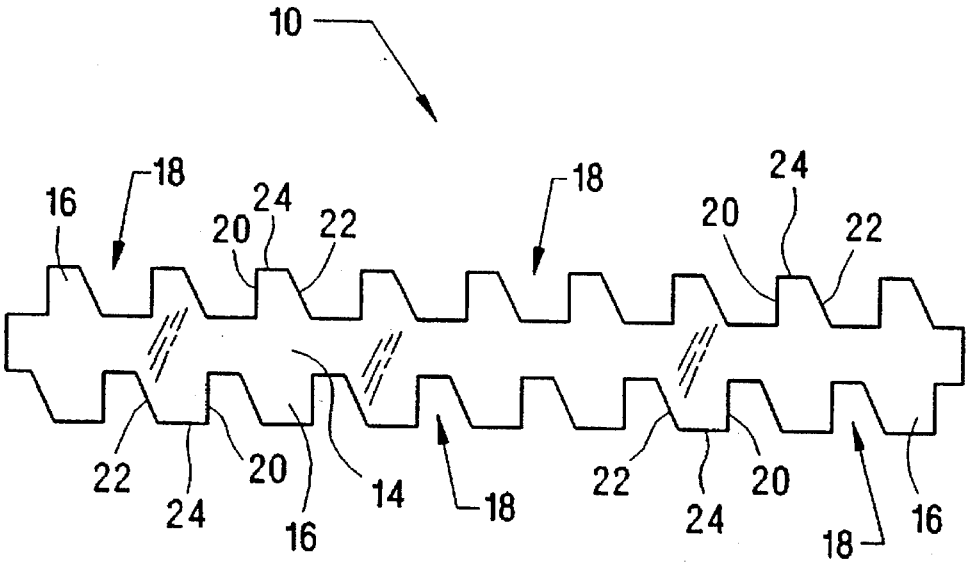
FIG. 8 is a longitudinal-elevation view showing the embodiment of FIG. 7.
Figure 9:
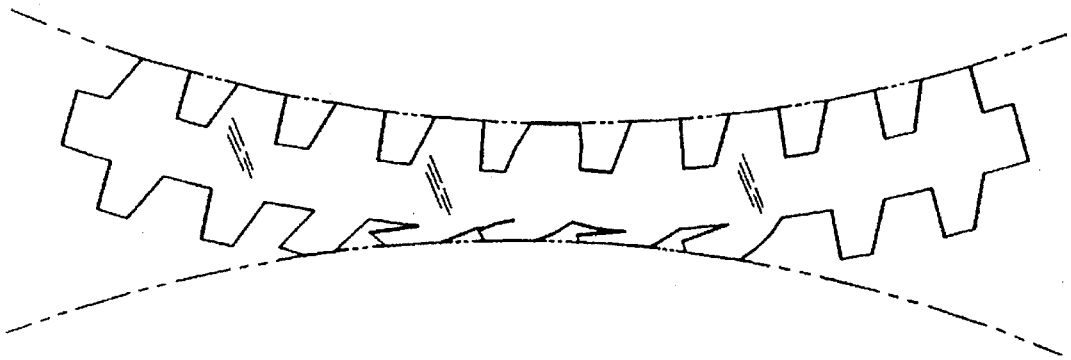
FIG. 9 is a longitudinal-elevation view showing the embodiment of FIG. 7 being subjected to a compressive force.

Referring now to FIGS. 7 and 8, a second embodiment of the scrap ejector 10 is shown. In the embodiment of FIG. 7, the lugs 16 are disposed opposite one another on each side of the web 14 rather than being staggered. The lugs 16 on the top of the web 14 (as seen in FIG. 8) are slightly smaller than the lugs 16 on the bottom of the web 14. Further, the lugs 16 include one side wall 20 which is perpendicular to the web 14 and another side wall 22 which forms an oblique angle with the web 14. When a compressive force is applied to one of the lugs 16, as shown in FIG. 9, the lugs 16 roll into an adjacent notch 18 on the same side of the web 14 as they squeeze between the cylinders. That is, the lugs bend in a direction parallel to the longitudinal axis of the scrap ejector 10. Thus, when the scrap ejector 10 returns to its original condition, it will apply a longitudinally-directed force to the scrap severed from the corrugated paper board. This longitudinal component of the force helps to free the scrap from the slot formed in the carton blank.

In both embodiments described, the lugs 16 and notches 18 on one side of the web 14 are complimentary to the lugs 16 and notches 18 on the opposite side of the web. Thus, the scrap ejector 10 can be nested with another such scrap injector. By using complimentary shapes for the lugs 16 and notches 18, a greater number of scrap ejectors 10 can be produced from a given amount of stock material thereby increasing the yield and lowering costs of producing the scrap ejectors 10.

Based on the foregoing, it will be seen that the scrap ejector 10 according to the present invention, through its geometric form, provides sufficient space in the cutting rule cavity to allow for deformation of the rubber. By allowing displacement of the rubber, the height of the scrap ejector can be increased without overloading and permanently deforming the ejector. The increased height of the ejector will result in improved performance.

Various modifications of the described embodiments will be apparent to those skilled in the art. For example, circular or oval shaped openings can be formed in a rubber strip between the contact edges to provide void areas for displacement of the rubber.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. In a cutting die for cutting corrugated board including a die board and a plurality of cutting rules projecting from the surface of the die board, said cutting rules defining a cavity, the improvement comprising a resilient scrap ejector mounted in said cavity for ejecting scrap from said cavity, said scrap ejector including:

a) an elongated web made of a resilient material and including a top surface and a bottom surface;

b) a plurality of first resilient lugs integrally formed with the web and projecting upwardly therefrom in longitudinal spaced apart relationship such that the lugs form the top surface of the scrap ejector and the lugs project upwardly and away from the die board;

c) a plurality of first notches formed between said first lugs;

d) a plurality of second resilient lugs integrally formed with the web and projecting downwardly therefrom in longitudinal spaced apart relationship such that the lugs form the bottom surface of the scrap ejector and the lugs project downwardly from the web and against the die board;

e) a plurality of second notches formed between said second lugs.

2. The cutting die of claim 1 wherein said first and second lugs are staggered with respect to one another.

3. The cutting die of claim 2 wherein said first and second lugs are shaped complimentary with respect to said first and second notches so that the scrap ejector can be nested with another such scrap ejector.

4. The cutting die of claim 1 wherein said lugs each include a pair of generally planar side walls extending from said elongated web, said contact face forming part of a respective one of the top and bottom surfaces, and a generally planar contact face disposed in a plane substantially parallel to the longitudinal axis of said elongated web.

5. The cutting die of claim 4 wherein at least one of said side walls is inclined with respect to the longitudinal axis of said web.

6. The cutting die of claim 5 wherein both of said side walls are inclined with respect to the longitudinal axis of said web.

7. The cutting die of claim 4 wherein a first one of said walls is inclined at an angle more than 90° from the longitudinal axis of said web and the second side wall is disposed at an angle of not more than 90° with respect to the longitudinal axis of said elongated web.

8. A cutting die including a die board, at least one cutting rule extending from the die board and having a cutting edge, the cutting rule in part forming a cavity with the die board, and an elongated resilient scrap ejector positioned in the cavity, the scrap ejector including a web, a top portion extending above the cutting edge of the cutting rule and a bottom portion adjacent the die board, the top portion including a plurality of lugs that project upwardly from the web and away from the die board and a plurality of open upper notches disposed between the upwardly projecting lugs; the bottom portion including a plurality of lugs that project downwardly from the web and toward the die board and a series of notches disposed between the downwardly projecting lugs, the lugs of the bottom portion forming a bottom surface which is disposed against the die board; the lugs including first and second side walls and wherein the first side wall is inclined at an angle of more than 90° with respect to the longitudinal axis of the scrap ejector and the second side wall disposed at an angle of not more than 90° with respect to the longitudinal axis of the scrap ejector such that the lugs bend in the longitudinal direction of the scrap ejector when subjected to a compressive force.

9. A cutting die including a die board, at least one cutting rule extending from the die board and having a cutting edge, said cutting rule forming a cavity with the die board and an elongated resilient scrap ejector positioned in the cavity, said scrap ejector having a top portion extending above the cutting edge of the cutting rule and a bottom portion adjacent the die board, said top and bottom portions each including a plurality of alternating lugs and notches, the notches forming displacement zones for the lugs, and wherein the lugs and notches along the top portion are staggered with respect to the lugs and notches along the bottom portion, and the lugs along the bottom portion form a bottom surface which is disposed against the die board.

10. A cutting die for cutting corrugated paper board including a die board, at least one cutting rule extending from the die board and having a cutting edge, the cutting rule in part forming a cavity with the die board, and an elongated scrap ejector positioned in the cavity and having a web, a top portion extending above the cutting edge of the cutting rule and a bottom portion adjacent the die board wherein; the top portion includes a plurality of lugs that project upwardly from the web and away from the die board and a plurality of open upper notches disposed between the upwardly projecting lugs; and wherein the bottom portion includes a plurality of lugs that project downwardly from the web and toward the die board and a series of open lower notches disposed between the downwardly projecting lugs, the lugs of the bottom portion forming a bottom surface which is disposed against the die board.

11. The cutting die of claim 10 wherein the profile of the lugs and notches along the top portion compliments the profile of the lugs and notches along the bottom portion so that the scrap ejector can be nested with another such scrap ejector.

12. The cutting die of claim 10 wherein said lugs include two opposing, generally planar side walls.

13. The cutting die of claim 12 wherein at least one of said side walls is inclined with respect to the longitudinal axis of said scrap ejector.

14. The cutting die of claim 12 wherein a first one of said side walls is inclined at an angle of more than 90° from the longitudinal axis of said scrap ejector and the second side wall is disposed at an angle of not more than 90° with respect to the longitudinal axis of said scrap ejector such that the lugs bend in the longitudinal direction when subjected to a compressive force.

* * * * *